United States Patent [19]

Stuntz

[11] 4,451,354

[45] May 29, 1984

[54] PROCESS FOR UPGRADING HYDROCARBONACEOUS OILS

[75] Inventor: Gordon F. Stuntz, Baton Rouge, La.

[73] Assignee: Exxon Research and Engineering Co., Florham Park, N.J.

[21] Appl. No.: 454,875

[22] Filed: Jan. 3, 1983

[51] Int. Cl.[3] ..... C10G 65/12; C10G 69/02

[52] U.S. Cl. ..... 208/56; 208/59; 208/89

[58] Field of Search ..... 208/56, 57, 58, 59, 208/89

[56] References Cited

U.S. PATENT DOCUMENTS

| | | | |
|---|---|---|---|
| 2,834,717 | 5/1958 | Shiah | 208/56 X |
| 3,147,206 | 9/1964 | Tulleners | 208/56 |
| 3,252,888 | 5/1966 | Langer, Jr. et al. | 208/56 |
| 3,407,134 | 10/1968 | Wunderlich et al. | 208/111 |
| 3,533,936 | 10/1970 | Weisz | 208/56 |
| 3,830,728 | 8/1974 | Mounce | 208/59 |
| 4,022,681 | 5/1977 | Sheng et al. | 208/57 |
| 4,166,026 | 8/1979 | Fukui et al. | 208/210 |

*Primary Examiner*—Curtis R. Davis
*Assistant Examiner*—O. Chaudhuri
*Attorney, Agent, or Firm*—Marthe L. Gibbons

[57] ABSTRACT

A process for upgrading a heavy hydrocarbonaceous oil is provided in which the heavy oil is hydrorefined in the presence of a hydrorefining catalyst at conditions to convert a portion of the heavy constituents of the oil, followed by cracking the hydrorefined oil in the presence of the hydrogen donor diluent. The hydrorefining and cracking stages are conducted at a relatively low hydrogen partial pressure while obtaining a high level of conversion of the heavy constituents of the oil.

7 Claims, 1 Drawing Figure

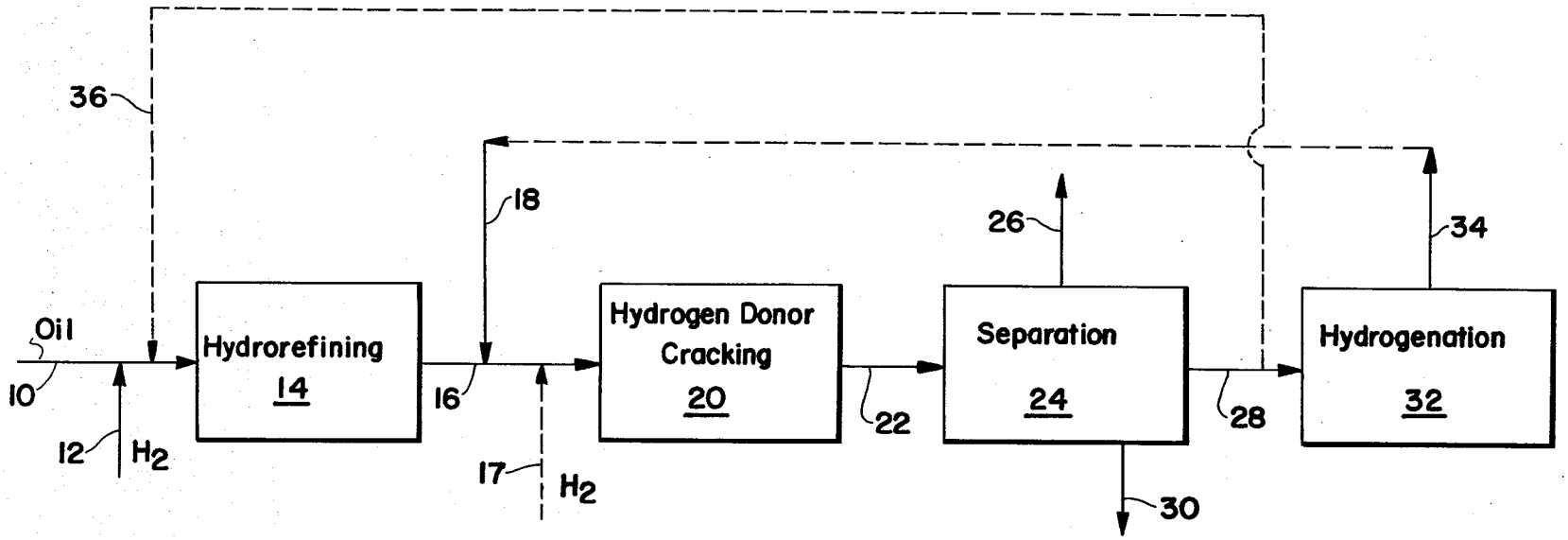
Oil
10
12
$H_2$
36
Hydrorefining
14
16
18
17
$H_2$
Hydrogen Donor Cracking
20
22
Separation
24
26
30
28
Hydrogenation
32
34

PROCESS FOR UPGRADING HYDROCARBONACEOUS OILS

BACKGROUND OF THE INVENTION

1. Field of the Invention

The present invention relates to a process for upgrading a sulfur-containing heavy hydrocarbonaceous oil by hydrodesulfurization of the oil and conversion of the heavy constituents of the oil.

2. Description of the Prior Art

Hydrodesulfurization processes in which a heavy hydrocarbonaceous oil is treated in the presence of hydrodesulfurization catalysts are known.

U.S. Pat. No. 4,166,026 discloses a fixed bed catalytic hydrodesulfurization and hydroconversion of heavy oils at a temperature of about 662° to 842° F. The total liquid effluent of the first reactor is passed to a second reactor. A heavy bottoms portion of the second reactor is recycled to the first reactor.

It has now been found that hydrorefining a heavy oil at conditions to convert at least a portion of the heavy constituents of the oil and subjecting the hydrorefined oil to additional cracking in the presence of a hydrogen donor diluent will provide advantages that will become apparent in the ensuing description.

The term "hydrorefining" is used herein to designate a catalytic treatment of the hydrocarbonaceous oil conducted in the presence of added hydrogen to upgrade the oil by eliminating or reducing the concentration of contaminants in the oil, such as sulfur compounds, nitrogenous compounds, and metal constituents of the oil, hydrogenation of unsaturated constituents of the oil and conversion of at least a portion of the heavy constituents of the oil.

SUMMARY OF THE INVENTION

In accordance with the invention there is provided, a process for upgrading a heavy hydrocarbonaceous oil feed comprising heavy constituents, which comprises the steps of:

(a) contacting said heavy oil feed with a hydrorefining catalyst in the presence of added molecular hydrogen-containing gas in a hydrorefining zone at hydrorefining conditions such as to convert at least a portion of the heavy constituents of said oil to lower boiling hydrocarbons, said hydrorefining conditions including a temperature ranging from about 680° to 775° F. and a hydrogen partial pressure ranging from about 800° to about 1500 psig to produce a hydrorefined oil;

(b) treating at least a portion of said hydrorefined oil in the presence of a hydrogen donor diluent and of molecular hydrogen in a cracking zone to crack at least an additional portion of said heavy constituents to lower boiling hydrocarbons, said cracking conditions including a temperature ranging from about 775° to 850° F. and a hydrogen partial pressure ranging from about 250 to 1500 psig, and (c) recovering an upgraded hydrocarbonaceous oil.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a sulfur-containing heavy hydrocarbonaceous oil comprising materials boiling above 1050° F. carried in line 10 in admixture with a molecular hydrogen-containing gas introduced via line 12 is passed into hydrorefining zone 14. All boiling points referred to herein are at atmospheric boiling points unless otherwise specified.

Sulfur-Containing Heavy Hydrocarbon Oils

Suitable sulfur-containing hydrocarbon oil feeds for the hydrorefining zone of the present invention are sulfur-containing hydrocarbonaceous oils comprising at least 10 volume percent materials boiling above 1050° F., preferably at least 25 volume percent boiling above 1050° F. The 1050° F.+ materials generally include asphaltenes. The initial boiling points of such oils will generally be above about 550 preferably above about 650° F., although whole crude oils may be used. Suitable oil feeds for the hydrorefining zone of the present invention include heavy crude mineral oils; residual petroleum fractions such as atmospheric residua and vacuum residua. Such residual oils usually contain large amounts of sulfur and metallic contaminants such as nickel and vanadium. The total metal content of such oils may range up to 2000 wppm or more and the sulfur content may range up to 8 weight percent or more. The Conradson carbon residue of the oils is generally above 2 weight percent, preferably from 5 to 50 weight percent, and more preferably above 7 weight percent (as to Conradson carbon, see ASTM Test D189-65). The sulfur-containing heavy hydrocarbon oil may be derived from any source, such as petroleum, shale oil, tar sand oil, heavy oils produced by coal liquefaction processes, including coal liquefaction bottoms, and mixtures thereof. The preferred oil feed is a petroleum residuum obtained by distillation or other treating or separation process.

The Hydrorefining Catalyst

A hydrorefining catalyst is disposed in hydrorefining zone 14. The catalyst may be disposed in a fixed bed, moving bed, ebullating bed, dispersed phase, fluidized bed. Preferably, the catalyst is disposed in zone 14 in a fixed bed. The hydrorefining catalyst may be any conventional hydrorefining catalyst. Suitable hydrorefining catalysts include a hydrogenation component such as a Group VIB and a Group VIII metal, metal oxide, metal sulfide and mixtures thereof composited with a support. The Group VIB and VIII refer to groups of the Periodic Table of Elements in accordance with the Table of *Handbook of Chemistry and Physics* by Chemical Rubber Company, Cleveland, Ohio, 45th edition, 1964. The catalyst may be, for example, a catalyst comprising cobalt, molybdenum, nickel, tungsten and mixtures thereof on an alumina support, which may additionally comprise silica. Suitable catalysts are described, for example, in U.S. Pat. Nos. 3,770,618; 3,509,044; and 4,113,656, the teachings of which are hereby incorporated by reference.

The hydrorefining zone is operated at relatively low temperatures and relatively low hydrogen partial pressure simultaneously to hydrodesulfurize and convert at least a portion of the 975° F.+ materials to lower boiling hydrocarbons. The space velocity (volume of feed per volume of reactor per hour) of the oil feed is adjusted to convert preferably 20 to 60 weight percent, more preferably from 25 to 40 weight percent of 975° F.+ materials present in the oil feed to lower boiling products. Suitable hydrorefining conditions are summarized in Table I.

TABLE I

| HYDROREFINING OPERATING CONDITIONS | | |
|---|---|---|
| Conditions | Broad Range | Preferred Range |
| Temperature, °F. | 680 to 775 | 700 to 750 |
| Total Pressure, psig | 1000 to 2000 | 1000 to 1500 |
| Hydrogen rate, scf/bbl | 1500 to 6000 | 2000 to 4000 |
| Hydrogen partial pressure, psig | 800 to 1500 | 800 to 1100 |

The effluent of the hydrorefining zone is removed by line 16. The effluent comprises a gaseous phase including hydrogen sulfide, hydrogen, ammonia, light hydrocarbon gases and a liquid phase which comprises a hydrorefined, hydrocarbonaceous oil having a decreased organic sulfur content relative to the initial oil feed as well as a decreased amount of 975° F.+materials. At least a portion of the total hydrorefining zone effluent is passed by line 16 into cracking zone 20 in admixture with a hydrogen donor diluent introduced into line 16 by line 18. If desired, a molecular hydrogen-containing gas may also be added to line 16 by line 17. Alternatively, the gaseous phase may be removed from the hydrorefining zone effluent in a conventional gas-liquid separation zone (not shown) and thereafter, the liquid phase may be passed into the cracking zone in admixture with an added molecular hydrogen-containing gas. Desirably, the hydrogen donor diluent is added to the hydrorefined effluent in an amount such as to provide a volumetric ratio of hydrogen donor diluent to hydrorefined oil ranging from about 0.5:1 to 2.0:1. The term "hydrogen donor diluent" is used herein to designate a fluid which comprises at least 25 weight percent, preferably at least 50 weight percent of compounds which are known to be hydrogen donors under the temperature and pressure conditions in the cracking zone. Although the hydrogen donor diluent may be comprised solely of one or a mixture of hydrogen donor compounds, the hydrogen donor diluent employed will normally be a product stream boiling between 350° to 1050° F., preferably between 400° F. and 700° F. derived from the process. The given fraction may be subjected to hydrogenation to hydrogenate the aromatic compounds present in the fraction to hydroaromatics. If desired, hydrogen donor compounds and/or hydrogen donor compound precursors may be added to the given fraction. Compounds known to be hydrogen donor compounds or precursors thereof include indane, $C_{10}$ to $C_{12}$ tetralins, decalins, methylnaphthalene, dimethylnaphthalene, $C_{12}$ to $C_{13}$ acenaphthenes, tetrahydroacenaphthene and quinoline. Suitable hydrogen donor diluents include hydrogenated creosote oil, hydrogenated intermediate product streams from catalytic cracking of hydrocarbon oils and coal derived liquids which are rich in hydrogen donor compounds or hydrogen donor precursors.

The mixture of hydrorefining zone effluent which comprises the hydrorefined oil which still contains some 975° F.+ constituents and hydrogen donor diluent is introduced into cracking zone 20 which is operated at conditions to crack an additional portion of the remaining 975° F.+ constituents to lower boiling hydrocarbon products, including a higher temperature than the actual temperature at which the hydrorefining zone is operated. Suitable cracking conditions in zone 20 are summarized in Table II.

TABLE II

| CRACKING OPERATING CONDITIONS | | |
|---|---|---|
| Conditions | Broad Range | Preferred Range |
| Temperature, °F. | 775 to 850 | 800 to 840 |
| Total Pressure, psig | 500 to 2000 | 1000 to 1500 |
| Hydrogen partial pressure, psig | 250 to 1500 | 800 to 1100 |

The effluent of cracking zone 20, including a cracked oil product, is removed by line 22 and passed to separation zone 24 which may be a fractional distillation zone wherein the effluent is separated into fractions including a light gas which is removed overhead by line 26. An intermediate boiling fraction boiling, for example, between 400° to 1050° F. is removed by line 28 and a heavy bottoms fractions, for example, 1050° F.+ material, is removed by line 30. A portion of the intermediate fraction may be passed to a hydrogenation zone 32 in which the fraction may be hydrogenated in the presence of a conventional hydrogenated catalyst, as is known in the art, to increase the amount of hydrogen donor compounds in that fraction. If desired, at least a portion of the hydrogenated fraction may be recycled to line 16 as a hydrogen donor diluent carried in line 18 for introduction into cracking zone 20. Alternatively, at least a portion of the intermediate fraction recovered by line 28 may be recycled by line 36 into line 10 to mix with the oil feed and molecular hydrogen-containing gas.

The following example is presented to illustrate the invention.

EXAMPLE

A Maya-West Texas atmospheric residuum comprising about 4.0 weight percent sulfur and having an initial boiling point of about 650° F. was hydrorefined at a hydrogen partial pressure of about 1100 psig and a temperature about 740° F. to give a 30.9 weight percent conversion of 975° F.+ materials in the presence of a nickel-molybdenum on silica stabilized alumina catalyst of the type described in U.S. Pat. No. 3,770,618. This run is herein designated Run No. 1. The hydrorefined hydrocarbonaceous oil product was additionally converted by cracking in the presence of a hydrogen donor diluent as follows: the hydrorefined oil was diluted with an equal weight of hydrogenated creosote oil (HCO, 1.4 weight percent donatable hydrogen) and heated at 835° F. for 3 hours under a hydrogen partial pressure of 933 psig. This run is herein designated Run No. 2. This gave an overall 975° F.+ conversion of 75.5 weight percent based on the initial Maya-West Texas atmospheric residuum feed. The coke produced (weight percent toluene insolubles) was relatively low. That is, 3.26 weight percent.

Another donor diluent cracking run herein, designated Run No. 3, was made as follows: a portion of the hydrorefined oil product of Run No. 1 was mixed with hydrogenated creosote oil at a weight ratio of 1:1 and heated at 835° F. and a hydrogen partial pressure of 473 psig for 2 hours. The overall conversion of 975° F.+ materials on initial residuum feed was 76.9 percent. The coke produced was 2.98 weight percent on initial feed.

The above example shows that hydrorefining followed by hydrogen donor diluent cracking gave high conversion of the 975° F.+ materials at relatively low hydrogen partial pressures.

The conversion is defined herein as follows:

$$975^\circ\ F.^+\ \text{Conversion} = \frac{(\text{wt. } 975^\circ\ F.^+ \text{ in feed} - \text{wt. } 975^\circ\ F. \text{ in product})}{(\text{wt. } 975^\circ\ F.^+ \text{ in feed})} \times 100$$

What is claimed is:

1. A process for upgrading a sulfur-containing heavy hydrocarbonaceous oil feed comprising heavy constituents, including at least 10 volume percent materials boiling above 1050° F., which consists essentially of the steps of:

(a) contacting said heavy oil feed with a hydrorefining catalyst in the presence of added molecular hydrogen in a hydrorefining zone at hydrorefining conditions such as to convert at least a portion of the heavy constituents of said oil to lower boiling hydrocarbons, said hydrorefining conditions including a temperature ranging from about 680° to 775° F. and a hydrogen partial pressure ranging from about 800 to about 1500 psig to produce a hydrorefined oil;

(b) contacting at least a portion of said hydrorefined oil in the presence of a hydrogen donor diluent and of molecular hydrogen in a cracking zone to crack at least an additional portion of said heavy constituents to lower boiling hydrocarbon, said cracking conditions including a temperature ranging from about 775° to 850° F. and a hydrogen partial pressure ranging from about 250 to 1500 psig; and (c) recovering an upgraded hydrocarbonaceous oil.

2. The process of claim 1, wherein said hydrorefining conditions include a temperature ranging from about 700° F. to 750° F. and a pressure ranging from about 800 to 1100 psig and wherein said cracking conditions include a temperature ranging from about 800° F. to about 840° F. and a hydrogen partial pressure of about 800 to about 1100 psig.

3. The process of claim 1, wherein said hydrogen donor diluent in said cracking zone of step (b) is present in a volumetric ratio of hydrogen donor diluent to said hydrorefined oil of about 0.5:1 to 2.0:1.

4. The process of claim 1, wherein said upgraded oil recovered in step (c) is separated into fractions, including an intermediate boiling fraction, and wherein at least a portion of said intermediate fraction is recycled to said hydrorefining zone.

5. The process of claim 1, wherein said upgraded oil recovered in step (c) is separated into fractions, including an intermediate boiling fraction, and wherein at least a portion of said intermediate fraction is hydrogenated and said hydrogenated fraction is recycled to said cracking zone.

6. The process of claim 1, wherein said hydrorefining catalyst comprises a hydrogenation component selected from the group consisting of a Group VIB metal component and a Group VIII metal component and mixtures thereof composited with a support.

7. The process of claim 1 wherein said sulfur-containing heavy hydrocarbonaceous oil feed comprises constituents boiling above 975° F. and wherein the space velocity of said oil in said hydrorefining zone is adjusted to provide from about 20 to about 60 weight percent conversion of materials boiling above 975° F. to materials boiling below 975° F.

* * * * *